US008050010B2

(12) United States Patent
Casasso et al.

(10) Patent No.: US 8,050,010 B2
(45) Date of Patent: Nov. 1, 2011

(54) METHOD AND AN APPARATUS FOR CONTROLLING GLOW PLUGS IN A DIESEL ENGINE, PARTICULARLY FOR MOTOR-VEHICLES

(75) Inventors: Paolo Casasso, Cuneo (IT); Angelo Argento, Turin (IT); Stefano Nieddu, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 318 days.

(21) Appl. No.: 12/432,387

(22) Filed: Apr. 29, 2009

(65) Prior Publication Data

US 2009/0268366 A1 Oct. 29, 2009

(30) Foreign Application Priority Data

Apr. 29, 2008 (EP) ..... 08008157

(51) Int. Cl.
*F23Q 7/00* (2006.01)
*F02P 19/02* (2006.01)

(52) U.S. Cl. ..... 361/284; 12/179.6

(58) Field of Classification Search ..... 361/264, 361/284; 123/179.6

See application file for complete search history.

(56) References Cited

U.S. PATENT DOCUMENTS

| | | | | |
|---|---|---|---|---|
| 5,158,050 | A | 10/1992 | Hawkins et al. | |
| 5,729,456 | A | 3/1998 | Boisvert et al. | |
| 2010/0109733 | A1* | 5/2010 | Guido et al. | 327/215 |

FOREIGN PATENT DOCUMENTS

| | | | |
|---|---|---|---|
| EP | 0638770 | A1 | 2/1995 |
| GB | 2062381 | A | 5/1981 |
| JP | 58023282 | A | 2/1983 |
| JP | 58070060 | A | 4/1983 |

* cited by examiner

*Primary Examiner* — Jared Fureman

*Assistant Examiner* — Lucy Thomas

(74) *Attorney, Agent, or Firm* — Ingrassia Fisher & Lorenz, P.C.

(57) ABSTRACT

A method is provided that includes, but is not limited to the steps of driving in an on-off manner in a period of time an electronic switch in series with a respective glow plug between the terminals of a d.c. voltage supply, sensing the glow plug voltage and the glow plug current, generating analogue sense signals representative of the time integral of the glow plug voltage and current, generating analogue reference signals corresponding to the digital values of corresponding control words, comparing the sense signals to the respective reference signals and modifying the corresponding control words so as to minimize the difference between the sense signals and the reference signals, calculating the average values of the sensed voltage and current on the basis of the values of the control words at the beginning and at the end of the "on" time of the electronic switch.

10 Claims, 3 Drawing Sheets

METHOD AND AN APPARATUS FOR CONTROLLING GLOW PLUGS IN A DIESEL ENGINE, PARTICULARLY FOR MOTOR-VEHICLES

CROSS-REFERENCE TO RELATED APPLICATION

This application claims priority to European Patent Application No. 08008157.3, filed Apr. 29, 2008, which is incorporated herein by reference in its entirety.

TECHNICAL FIELD

The present invention relates to a method and an apparatus for controlling glow plugs in a Diesel engine, and more particularly to a method and an apparatus for controlling glow plugs in a Diesel engine for motor-vehicles.

BACKGROUND

Glow plugs are typically associated with the cylinder chambers of Diesel engines, and are controlled by an associated electronic control module which is arranged to control in real time the amount of energy transferred to each glow plug, so as to reach and hold a predetermined working temperature. The electronic control module drives the electronic switches, generally MOSFET transistors, by means of pulse-width-modulated (PWM) control signals.

The energy transferred to the glow plugs is the key variable to be controlled, and the glow-plug control systems generally monitor both the voltage across each glow plug and the current flowing through each glow plug.

Controlling the energy transferred to the glow plugs means controlling the power transferred thereto during each period of the PWM driving signals applied to the corresponding electronic switches. The duty-cycle of the PWM driving signals is controlled in a closed-loop, in order to supply the desired energy to each glow plug.

With the presently known control systems the best control performances are achieved through a direct determination of the rms values of the voltage and current waveforms for each period of the PWM driving signals. Such a solution involves remarkable difficulties, in particular due to the high sensitivity to external noise and the complexity of the hardware circuitry and the digital processing needed.

Some known solutions are based on sampling the glow plug voltage and current by means of a so-called high sampling task, with a view to digitally computing the rms values thereof. This solution requires expensive and very fast analogue channel converters, and this adversely affects the digital control throughput and the overall cost of the glow plug control system.

In order to avoid the need for a fast sampling task, it has been proposed to sample the glow plug voltage and current only once per period of the PWM driving signals, for instance at the middle of the "on" phase of said signals. Such a solution indeed solves the issue of the fast sampling, but introduces in turn an important error into the calculation of the rms values of the glow plug voltage and current.

In view of the foregoing, it is at least one object of the present invention to provide an improved method and an improved apparatus for controlling glow plugs in a Diesel engine, allowing to overcome the above-outlined inconveniences of the prior art systems. In addition, other objects, desirable features, and characteristics will become apparent from the subsequent summary and detailed description, and the appended claims, taken in conjunction with the accompanying drawings and this background.

SUMMARY

A method for controlling a glow plug associated with a cylinder chamber of a Diesel engine is provided that comprises the steps of driving in an on-off manner in a period of time an electronic switch connected essentially in series with the glow plug between the terminals of a D.C. voltage supply, sensing the voltage across the glow plug and the current flowing through the glow plug, generating a first and a second analogue sense signal representative of the time integral of the sensed current and the sensed voltage, respectively, generating a first and a second reference signal having respective analogue values corresponding to the values of a first and a second digital control word, respectively, comparing, while the electronic switch is "on", the first and the second sense signal with the first and the second reference signal, respectively, modifying the digital value of said digital words so as to minimize the difference between the sense signals and the corresponding reference signals, and calculating the average values of the sensed current and the sensed voltage, respectively, over said period of time, as a function of the differences between the values of said first and second digital word, respectively, at the beginning and at the end of the "on" or conduction time of the electronic switch.

An apparatus for controlling a glow plug associated with a cylinder chamber of a Diesel engine is provided that comprises an electronic switch connected essentially in series with the glow plug between the terminals of a d. c. voltage supply, sensing means for providing a first and a second analogue sense signal representative of the current flowing through the glow plug and the voltage across the glow plug, respectively, and electronic control means coupled to a control input of the electronic switch and to said sensing means; the control means being arranged for driving, in an on-off manner said electronic switch. The electronic control means are further arranged for generating a first and a second analogue sense signal representative of the time integral of the sensed current and the sensed voltage, respectively, generating a first and a second reference signal having respective analogue values corresponding to the values of a first and a second digital control word, respectively, comparing, while the electronic switch is "on," the first and the second sense signal with the first and the second reference signal, respectively, modifying the digital value of said digital words so as to minimize the difference between the sense signals and the corresponding reference signals, and calculating the average values of the sensed current and of the sensed voltage, respectively, over said period of time, as a function of the differences between the values of said first and second digital words, respectively, at the beginning and at the end of the "on" or conduction time of the electronic switch.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
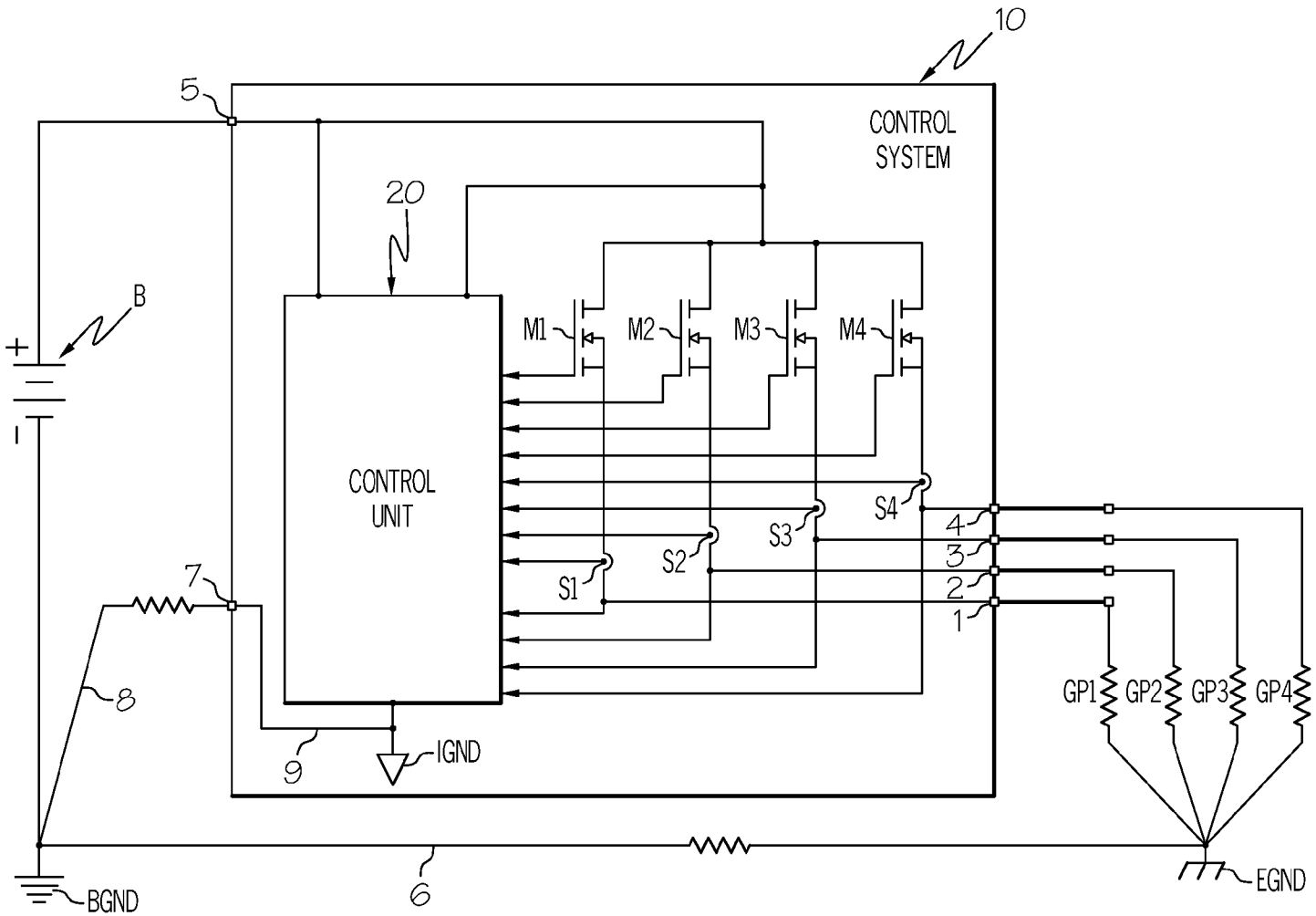
FIG. 1 is an electric diagram showing an apparatus for controlling glow plugs in a Diesel engine.

In FIG. 1, reference numeral 10 generally indicates an electronic control system for driving the glow plugs GP1, GP2, GP3 and GP4 associated each with a respective cylinder chamber in a 4-cylinder Diesel internal combustion engine. The glow plugs GP1-GP4 are connected each between a respective output terminal 1-4 of the electronic control system 10 and a ground terminal EGND ("engine ground").

In FIG. 1, a D.C. voltage supply B, such as the battery of the motor-vehicle, has its positive terminal connected to a supply input 5 of the electronic control system 10, and the negative terminal connected to a ground terminal BGND ("battery ground").

The ground terminal BGND is connected to the ground terminal EGND by a conductor 6, and is further connected to a terminal 7 of the electronic control system 10 through a conductor 8. The terminal 7 of the electronic control system is connected to an internal ground terminal IGND of the electronic control system 10, through a conductor 9.

The electronic control system 10 comprises four electronic switches M1-M4, having each the drain-source path connected essentially in series with a respective glow plug, between the terminals of the voltage supply B. The electronic switches M1-M4 are, for instance, MOSFET transistors, and have their gates connected to respective outputs of a control unit 20.

The unit 20 has a first series of four inputs which are connected each to a respective one of the terminals 1-4, to provide said unit with an analogue signal representative of the voltage across the corresponding glow plugs GP1-GP4. The unit 20 has a second series of four inputs, which are connected each to a respective current-sensing means S1-S4, such as a shunt resistor, to provide said unit 20 with signals representative of the current flowing in the operation through each of the glow plugs.

In the arrangement shown in FIG. 1, the current sensors S1-S4 are arranged between the electronic switches M1-M4 and the glow plugs GP1-GP4. In an essentially equivalent arrangement, the sensors could be arranged between the electronic switches M1-M4 and the positive terminal of the voltage supply B.

Figure 2:
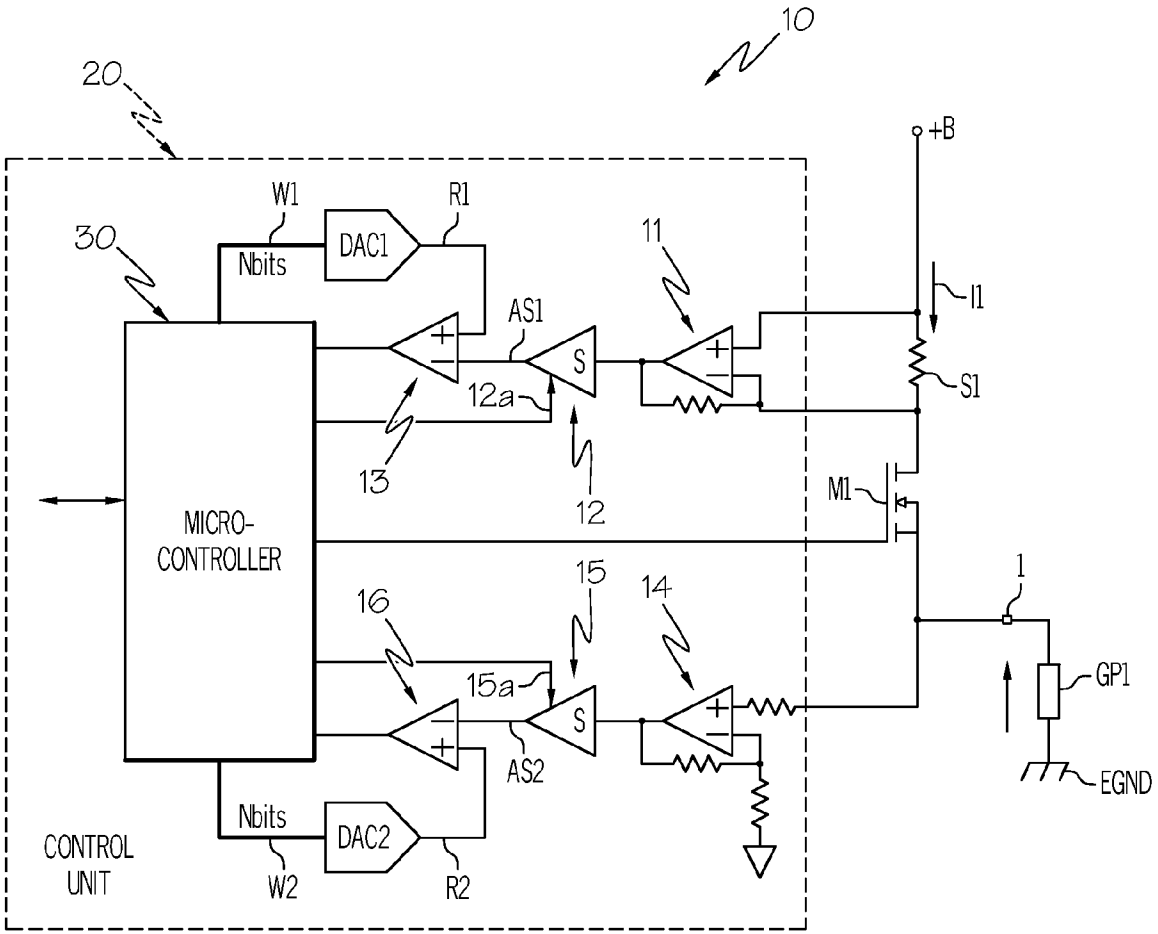
FIG. 2 is an electric diagram showing in a greater detail part of the control unit of FIG. 1, for controlling a single glow plug of a Diesel engine.

Referring to FIG. 2, the operation of the electronic unit 20 will be now described, in connection with the control of a single glow plug, for instance glow plug GP1. The other glow plugs GP2-GP4 are controlled similarly.

In the embodiment of FIG. 2, the current-sensing shunt resistor S1 is shown as connected between the drain of the MOSFET transistor M1 and the positive terminal of the supply source B. The ends of the shunt resistor S1 are connected to the inputs of a conditioning circuit 11, which may usually include a current mirror structure. The conditioning circuit 11 filters the voltage across the shunt resistor S1, and then rescales the shunt voltage to the typical 0-5V voltage range currently in use for automotive analogue signals.

The signal at the output of the conditioning circuit 11 is applied to the input of an analogue integrator 12, having a reset input 12*a*. The integrator 12 provides at its output a sense signal AS1 representative of the time integral of the current I1 sensed by means of the shunt resistor S1.

The output of the integrator 12 is coupled to the inverting input of an analogue comparator 13, which continuously compares the said sense signal AS1 with an analogue reference signal R1 provided by the output of a digitally-driven analogue voltage generator DAC1, typically a digital-analogue converter. The reset input 12*a* of the integrator 12, the output of the comparator 13, and the input of the generator DAC1 are connected to corresponding terminals of a microcontroller 30. The generator DAC1 provides at its output a reference signal R1 having an analogue value which corresponds to the digital value at first digital control word W1 provided at its input by the microcontroller 30.

The microcontroller 30 performs a closed-loop control, so as to minimize the difference between the analogue values of the integrator signal AS1 and the reference signal R1. Whenever the output of the comparator 13 is (for instance) "low", this means that the integrator signal AS1 is greater than the reference signal R1 provided by the generator DAC1, and the microcontroller 30 will therefore increase the digital value associated with the control word W1 provided at the input of DAC1. On the other hand, if the output of the comparator 13 is "high", this means that the integrator signal AS1 is lower than the reference value R1, and the microcontroller 30 in this case will reduce the digital value of the control word W1.

Still referring to FIG. 2, the control unit 20 comprises further a second conditioning circuit 14 having its input connected to the terminal 1 (i.e., to the corresponding glow plug GP1.) The voltage conditioning circuit 14 filters the glow plug voltage V1, and rescales it to the typical 0-5V voltage range used for automotive analogue signals. In the embodiment shown, the conditioning circuit 14 includes an operational amplifier. In other embodiments, such a conditioning circuit might include a simple voltage divider. The voltage at the output of conditioning circuit 14 is coupled to the input of an integrator 15 having a reset input 15*a* coupled to a corresponding terminal of the microcontroller 30.

The analogue integrator 15 provides at its output an analogue sense signal AS2 representative of the time integral of the sensed glow plug voltage V1. The output of the integrator 15 is connected to the inverting input of a comparator 16, which has a non-inverting input coupled to the output of a digitally-driven voltage generator DAC2, similar to DAC1. The generator DAC2 is arranged to provide at its output an analogue reference signal R2 having a value corresponding to the digital value of a second digital control word W2 provided at its input by the microcontroller 30. The microcontroller 30 is arranged to carry out a closed-loop control of the control word W2 applied to the generator DAC2, so as to minimize the difference between the analogue values of the sense signal AS2, in a manner similar to that described above in connection with the current-sensing portion of the system.

Referring to FIG. 1 and FIG. 2, the control unit 20 is arranged to calculate the average values of the sensed voltage and the sensed current, respectively, over each period of the PWM driving signals applied to the gates of the switches M1-M4. This is done essentially as follows.

For each period of time, the control unit 20 computes the average value of the sensed current, for instance the current I1 (FIG. 2) through glow plug GP1, by calculating the ratio of:

a. the difference between the values of the first digital word W1 at the beginning and at the end of the "on" or conduction time of the corresponding electronic switch (M1), to b. the duration of said period of time (period of the PWM driving signal).

Similarly, the control unit 20 is arranged to calculate the average value of the sensed voltage across each glow plug, for instance the voltage V1 across glow plug GP1 (FIG. 2), by calculating the ratio of:

a. the difference between the values of the second digital word W2 at the beginning and at the end of the "on" or conduction time of the corresponding electronic switch (M1), to b. the duration of said period of time.

Having thus calculated the average values of the sensed voltage and the sensed current for each glow plug, the control unit 20 can easily calculate the corresponding rms values, in one of the various known manners.

Figure 3:
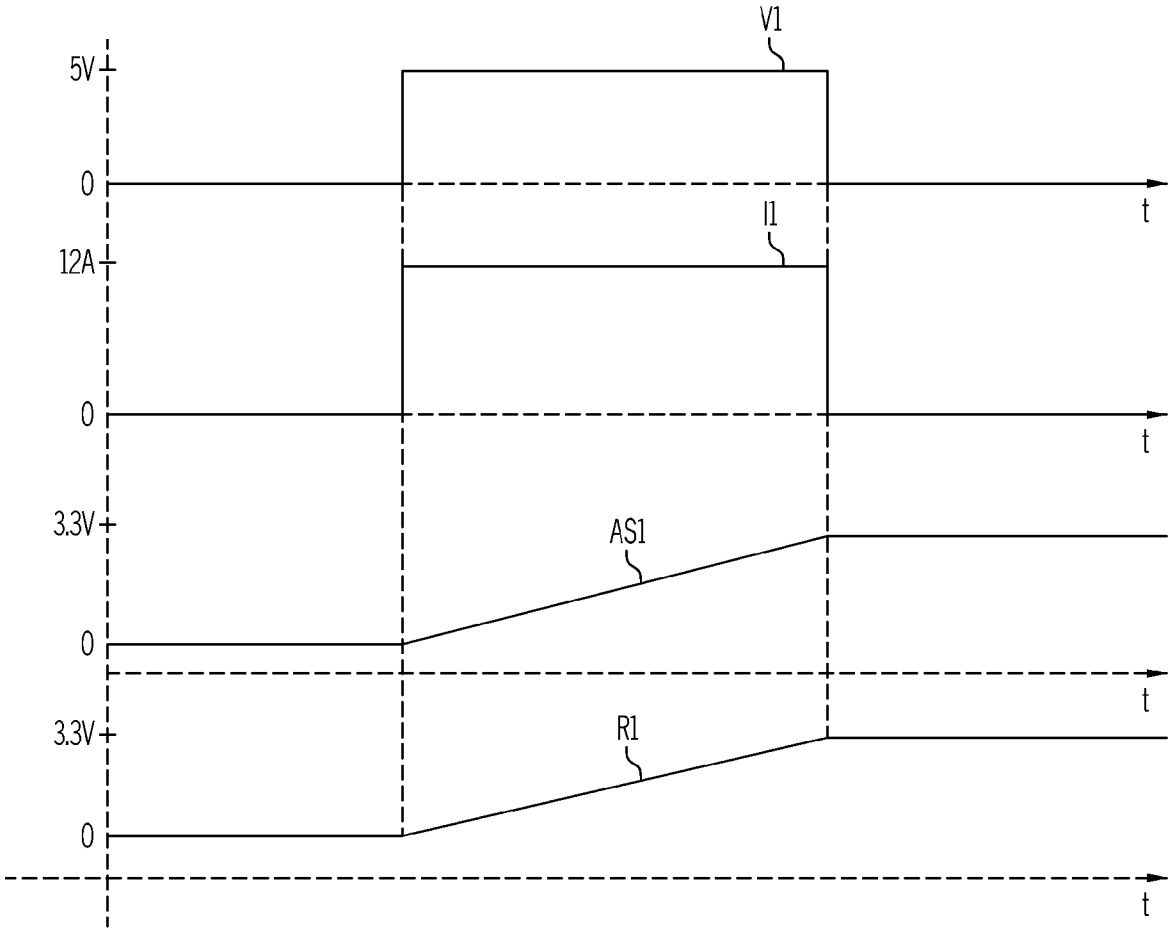
FIG. 3 is a series of four diagrams showing, as a function of time, the waveforms of four signals in the control systems of FIG. 1 and FIG. 2.

FIG. 3 shows exemplary waveforms of the voltage V1 sensed across glow plug GP1 and the corresponding current I1 flowing there through, as well as the corresponding waveforms of the integrated signal AS1 and the associated reference signal R1.

The system disclosed above has a number of advantages. Firstly, the system described above does not need any sample-and-hold circuits, with beneficial savings in cost. Furthermore, the system described above greatly reduces the sampling time of the generators DAC1 and DAC2, because the corresponding analogue integrators 12 and 15 can be considered as very low pass filters. The disclosed system has finally a quite low sensitivity to noise, because, as already mentioned above, the analogue integrators can be considered as very low pass filters.

Clearly, provided that the principle of the invention is retained, the forms of embodiment and the details of manufacture may vary greatly from what has been described and illustrated purely by way of non-restrictive example, without thereby departing from the scope of the invention as defined in the accompanying claims. Moreover, while at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A method for controlling a glow plug associated with a cylinder chamber of a diesel engine, comprising the steps of:

driving in an on-off manner, in a period of time, an electronic switch connected essentially in series with the glow plug between terminals of a D.C. voltage supply;

sensing a voltage across the glow plug and a current flowing through the glow plug;

generating a first analog sense signal that is representative of a first time integral of a sensed current;

generating a second analog sense signal that is representative of a second time integral of a sensed voltage;

generating a first reference signal having a first analog value corresponding to a first digital control word;

generating a second reference signal having a second analog value corresponding to a second digital control word;

comparing, while the electronic switch is in an on-state, the first analog sense signal with the first reference signal and the second analog sense signal with the second reference signal;

modifying a digital value of the first digital control word and the second digital control word to minimize the difference between the first analog sense signal and the first reference signal, and the difference between the second analog sense signal and the second reference signal; and calculating an average value, of the sensed current over said period of time, as a function of the difference between said first digital control word at a beginning and at an end of the on-state or a conduction time of the electronic switch, and of the sensed voltage over said period of time, as a function of the difference between said second digital control word at the beginning and at the end of the on-state or a conduction time of the electronic switch.

2. The method of claim 1, wherein the average value of the sensed current over the period of time is computed by calculating a ratio of the difference between values of the first digital control word at the beginning and at the end of the on-state or the conduction time of the electronic switch, to a duration of the period of time.

3. The method of claim 1, wherein the average value of the sensed voltage over the period of time is computed by calculating a ratio of the difference between values of the second digital control word at the beginning and at the end of the on-state or the conduction time of the electronic switch to a duration of said period of time.

4. The method according to claim 1, wherein the electronic switch is driven by a PWM signal.

5. The method according to claim 1, wherein the current flowing through the glow plug is sensed with a shunt resistor.

6. An apparatus for controlling a glow plug associated with a cylinder chamber of a diesel engine, comprising:

an electronic switch connected essentially in series with the glow plug between terminals of a D.C. voltage supply;

a sensor adapted to provide a first analog sense signal and a second analog sense signal representative of a current flowing through the glow plug and a voltage across the glow plug; and an electronic controller coupled to a control input of the electronic switch and to the sensor, the electronic controller adapted to:

drive in an on-off manner the electronic switch;

generate the first analog sense signal that is representative of a first time integral of a sensed current;

generate the second analog sense signal that is representative of a second time integral of a sensed voltage;

generate a first reference signal having a first analogue value corresponding to a value of a first digital control word;

generate a second reference signal having a second analogue value corresponding to a second digital control word;

compare, while the electronic switch is in an on-state, the first analog sense signal with the first reference signal and the second analog sense signal with the second reference signal;

modify a digital value, of the first digital control word, to minimize the difference between the first analog sense signal and the first reference signal, and of the second digital control word, to minimize the difference between the second analog sense signal and the second reference signal; and calculate an average value, of the sensed current over a period of time, as a function of the difference between said first digital control word at a beginning and at an end of the on-state or a conduction time of the electronic switch, and of the sensed voltage over said period of time, as a function of the difference between said second digital control word at the beginning and at the end of the on-state or a conduction time of the electronic switch.

7. The apparatus of claim 6, wherein the electronic controller is adapted to compute the average value of the sensed current over the period of time by calculating a ratio of the difference between values of said first digital control word at the beginning and at the end of the on-state or the conduction time of the electronic switch, to a duration of the period of time.

8. The apparatus according to claim 6, wherein the electronic controller is adapted to compute the average value of the sensed voltage over the period of time by calculating a ratio of the difference between values of said second digital control word at the beginning and at the end of the on-state or the conduction time of the electronic switch to a duration of the period of time.

9. The apparatus according to claim 6, wherein the electronic controller is adapted to drive the electronic switch with a PWM signal.

10. The apparatus according to claim 6, wherein the sensor comprises a shunt resistor.

* * * * *